US006792930B1

(12) United States Patent
Kronengold et al.

(10) Patent No.: US 6,792,930 B1
(45) Date of Patent: Sep. 21, 2004

(54) SINGLE-CAM SPLIT-HARNESS COMPOUND BOW

(75) Inventors: David H. Kronengold, Tucson, AZ (US); Jack W. Bowman, Jr., Tucson, AZ (US); Ronald L. Higgins, Tucson, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 0 days.

(21) Appl. No.: 10/682,939

(22) Filed: Oct. 10, 2003

(51) Int. Cl.[7] ..... F41B 5/10
(52) U.S. Cl. ..... 124/25.6
(58) Field of Search ..... 124/25.6

(56) References Cited

U.S. PATENT DOCUMENTS

| | | | | |
|---|---|---|---|---|
| 4,060,066 | A | 11/1977 | Kudlacek | 124/23 R |
| 4,300,521 | A | 11/1981 | Schmitt | 124/23 R |
| 4,541,401 | A | 9/1985 | Caldwell | 124/24 R |
| 4,669,445 | A | 6/1987 | Schaar | 124/23 R |
| 4,781,167 | A | 11/1988 | Martin | 124/23 R |
| 5,368,006 | A | 11/1994 | McPherson | 124/25.6 |
| 5,390,655 | A | 2/1995 | Mitchell et al. | 124/25.6 |
| 5,505,185 | A | 4/1996 | Miller | 124/25.6 |
| 5,623,915 | A | 4/1997 | Kudlacek | 124/25.6 |
| 5,890,480 | A | 4/1999 | McPherson | 124/25.6 |
| 6,112,732 | A | 9/2000 | Larson | 124/25.6 |
| 6,237,582 | B1 | 5/2001 | McPherson | 124/25.6 |
| RE37,544 | E | 2/2002 | Darlington | 124/25.6 |
| 6,443,139 | B1 | 9/2002 | McPherson | 124/25.6 |
| 6,470,870 | B1 | 10/2002 | Schaar | 124/25.6 |
| 6,474,324 | B1 | 11/2002 | Despart et al. | 124/25.6 |
| 6,516,790 | B1 | 2/2003 | Darlington | 124/25.6 |
| 6,659,096 | B1 * | 12/2003 | Nealy et al. | 124/25.6 |
| 2002/0129803 | A1 | 9/2002 | Larson | 124/25.6 |

* cited by examiner

*Primary Examiner*—John A. Ricci
(74) *Attorney, Agent, or Firm*—Cahill, von Hellens & Glazer, P.L.C.

(57) ABSTRACT

A single-cam compound bow (200) has two stretches (213, 214) of bowstring (212) and two stretches (227, 228) of cable (226) extending between free outer ends (207, 211) of the limbs (204, 208). A cam (217) is attached to a free outer end of one limb. One or more pulleys (320, 330) are attached to a free outer end of another limb. In one embodiment, the one or more pulleys attached to the free outer end of the other limb include one or more mechanical pulleys (1002, 1202, 1203). One end of cable is attached to sides (435, 436) of a fork (215) at the free outer end of the limb having the cam.

20 Claims, 4 Drawing Sheets

SINGLE-CAM SPLIT-HARNESS COMPOUND BOW

BACKGROUND OF THE INVENTION

1. Field of the Invention

This invention relates generally to archery bows, and more particularly to compound bows having a single cam.

2. Description of the Related Art

Compound bows comprise a pair of flexible limbs extending from opposite ends of a center handle or riser. The limbs are deflected by the operation of a bowstring in the same fashion as a traditional bow, but the bowstring is connected to the limbs through a system that includes one or more cams and cable stretches that transfer a multiple of the bowstring tension to the limbs. The bowstring and cable stretches may comprise a single continuous loop but, more typically, the bowstring is special bowstring material, and the, cable stretches are aircraft-type cable. The bowstring and cable stretches together are referred to rigging.

Compound bows differ from traditional bows in that compound bows have "let-off" leveraging devices typically mounted within a two-tine fork at a free end of each limb, distal from the riser. These leveraging devices are usually pulleys, although they may take various forms, including some with other than circular cross-sections. The leveraging devices are called eccentrics, or cams, because they are pivoted around an axle located off center with respect to their perimeters. In a two-cam compound bow, each limb tip carries a transverse axle upon which a cam is rotatably mounted. In a single-cam compound bow, only one of the limb tips has a cam—the other limb tip has a pulley.

Each cam has grooves or tracks similar to the grooves in a conventional pulley. A bowstring is reeved, or wound, around the bowstring pulley and the bowstring cam. A bowstring track is arranged alternately to pay out or take up bowstring as the limbs are alternately flexed to drawn or relaxed to a braced condition. A cam has at least one bowstring track and a cable track. A cable track is arranged alternately to take up portions of the cable as bowstring is paid out while the cam pivots to drawn condition and to pay out portions of the cable as the bowstring is wound onto the bowstring track while the cam pivots to the braced condition.

During operation of the compound bow, the bowstring lengthens as the bowstring is pulled back because as the one or more cams pivot from the braced condition, portions of the bowstring stored in the bowstring tracks unwind and are paid out. Concurrently, portions of the cable are wound onto the cable tracks of the cams so that the cable decreases in length. The opposite occurs as the bowstring is released, permitting the cams to pivot back to their braced condition.

The rigging includes cable stretches oriented approximately parallel the bow bowstring. The cable is commonly positioned to one side of the bowstring to avoid interference with the bowstring. A cable guard rod is mounted to the riser, and a cable guide is slidably mounted on the cable guard rod. The cable guide holds the cable away from the plane of travel of the bowstring.

With a compound bow oriented in its normal position of use, it is conventional to consider the bow as oriented vertically. Therefore, the riser has an "upper end" and a "lower end". The limb extending from the upper end of the riser may be referred to as an "upper limb" terminating in an "upper limb tip". Corresponding terminology is applied to the "lower limb" that extends from the lower end of the riser.

One problem with prior art compound bows is the presence of unbalanced cable loads. Specifically, the cable loads are unbalanced because the ends of the cables connected to the ends of the limbs are not attached inline with the longitudinal axis of the limbs; during draw, these unbalanced cable loads cause a twisting of the limbs. Frequent longitudinal twisting accelerates fatigue and breakage of limbs. Also, the cable can slip from the grooves of the pulley that is tilted.

A torque or twisting force on the limbs occurs as a result of the cams, which varies as the bowstring is drawn and released. Single-cam compound bows have one circular pulley at one of the limb tips. Limb torque is not a major problem at the limb that carries the pulley because the cable segment can be anchored to the limb at both sides of the pulley, and because the grooves in the pulley can be placed very close to the limb centerline. However, at the limb that carries the cam, limb torque is a major problem because the bowstring and cable segments engage the cam at laterally spaced positions. These cable segments apply a torque through the cam axle to the limb. This problem is exacerbated when a cable guard is employed on the bow because the cable guard offsets the cable segments from the limb centerline. Furthermore, the torque on the limb that carries the single-cam is usually greater than the torque on either limb of a two-cam compound bow, at least in part because of the larger diameter of the cam of a single-cam compound bow.

FIG. 1 shows a prior art single-cam compound bow 100 and its rigging 102. One end of the bowstring 104 is at least partially wound around a first bowstring track in the cam 106 at the bottom limb tip 108. The bowstring 104 extends across the bow in a first stretch 105, and is wound around a bowstring pulley 110 at the top limb tip 112. The bowstring 104 extends across the bow again in a second stretch 113 and the other end of the bowstring is at least partially wound around a second bowstring track in the cam 106 at the bottom limb tip 108. A cable 116 is at least partially wound around a cable track in the cam 106, extends across the bow in a single stretch 117, and terminates with a split harness 118 at the top limb tip 112.

Torque is applied to cam 106 about axes in two separate planes. Rotational torque is applied about the axis of rotation of the cam. Limb torque is applied about an axis in a plane normal to the axis of rotation of the cam. Limb torque attempts to tip the cam sideways and is opposed by the limbs, thus developing a torsion in the limb tips.

Rotational torque is applied to the cam by the force of the bowstring acting in the bowstring groove of the cam and by the force of the cable acting in the cable groove. The lever arm through which each of the cable and bowstring applies its torque is the distance from the axle to the point of tangency of the cable or bowstring in the groove.

When the pulley is not rotating, such as when the bow is held at full draw, the rotational torque applied by the cable and by the bowstring are equal and in opposite directions. The force applied by the bowstring multiplied by the lever arm in the bowstring groove, equals the force applied by the cable multiplied by the lever arm in the take-up groove.

Total limb torque applied to the limbs is determined by the magnitude of the force vectors applied by the bowstring and cable sections and by their respective placement along the pulley axle. The axis about which limb torques are applied, the limb torsional axis passes through and extends normal to the rotational axis of the cam. The exact location of the limb torsional axis depends upon the composition and structure of the limb. Therefore, the distance along the axle upon which the cam rotates defines the lever arm for that force, and the limb torque produced by the force equals the magnitude of the force multiplied by the lever arm for the force.

With prior art single-cam bows, limb torque causes cam axle bushings to be replaced annually, whereas without excessive limb torque, the bushings would last the life of the bow.

With prior art single-cam compound bows, limb torque causes undue bowstring wear and bowstrings last only six months because they have a tendency to come out of the cam groove.

Prior art single-cam compound bows suffer from vibration, noise and frictionally introduced hesitation effects as the cable guide moves along the cable guard rod.

Prior art single-cam compound bows lack a split harness at the free end of the limb having the cam.

OBJECTS OF THE INVENTION

It is therefore the object of the present invention to provide a single-cam compound bow in which torque applied to the power-cam limb, as the bow is drawn and released, is reduced or eliminated.

It is another object of the present invention to provide a compound bow having a reduced failure rate.

It is still another object of the present invention to provide a compound bow having reduced vibration.

It is yet another object of the present invention to provide a compound bow having a longer lasting bowstring.

It is yet another object of the present invention to provide a compound bow having reduced wear on axles of idler pulleys.

It is a further object of the present invention to provide a torqueless buss cable positioner for compound bows, whereby the buss cables are laterally displaced with respect to the bow plane, while involving very little bow noise and vibration.

It is a further object of the present invention to provide a shorter cable guard rod.

It is a further object of the present invention to provide a compound bow in which the distance that the cable guide travels on the cable guard rod is minimized.

It is a further object of the present invention to provide a bow with counter-rotating idler pulleys.

It is still a further object of the present invention to provide a compound bow having a lighter spine limb.

These and other objects of the present invention will become apparent to those skilled in the art as the description thereof proceeds.

SUMMARY OF THE INVENTION

Briefly described, and in accordance with a preferred embodiment thereof, the present invention relates to a single-cam compound bow that incorporates a riser, a first limb and a second limb. Each limb has an inner end connected to the riser and a free outer end. Two stretches of a bowstring extend between the free outer ends of the limbs, and two stretches of cable extend between the free outer ends of the limbs.

Other aspects, features and advantages of the present invention will become apparent to those skilled in the art from the following detailed description and the accompanying drawings. It should be understood however that the detailed description and specific examples, while indicating preferred embodiments of the present invention, are given by way of illustration only and various modifications may naturally be performed without deviating from the present invention.

BRIEF DESCRIPTION OF THE DRAWINGS

The present invention will be described with greater specificity and clarity with reference to the following drawings, in which.

Figure 1:
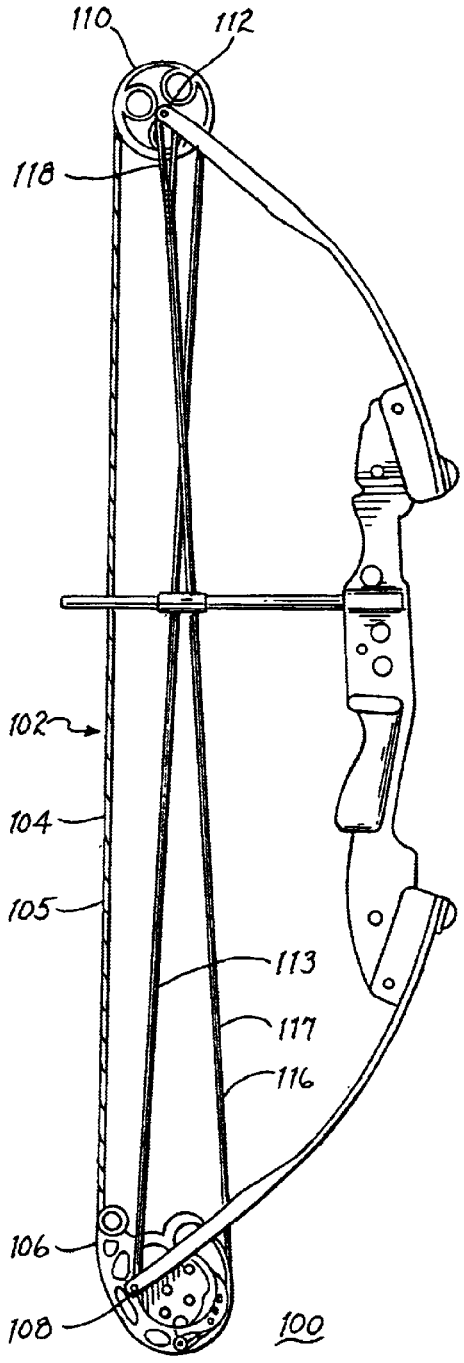
FIG. 1 (PRIOR ART)
FIG. 1 is a side view of a prior art single-cam compound bow.

For simplicity and clarity of illustration, the drawing figures illustrate the general manner of construction, and descriptions and details of well-known features and techniques are omitted to avoid unnecessarily obscuring the invention. Additionally, elements in the drawing figures are not necessarily drawn to scale.

DESCRIPTION OF THE PREFERRED EMBODIMENT

Figure 2:
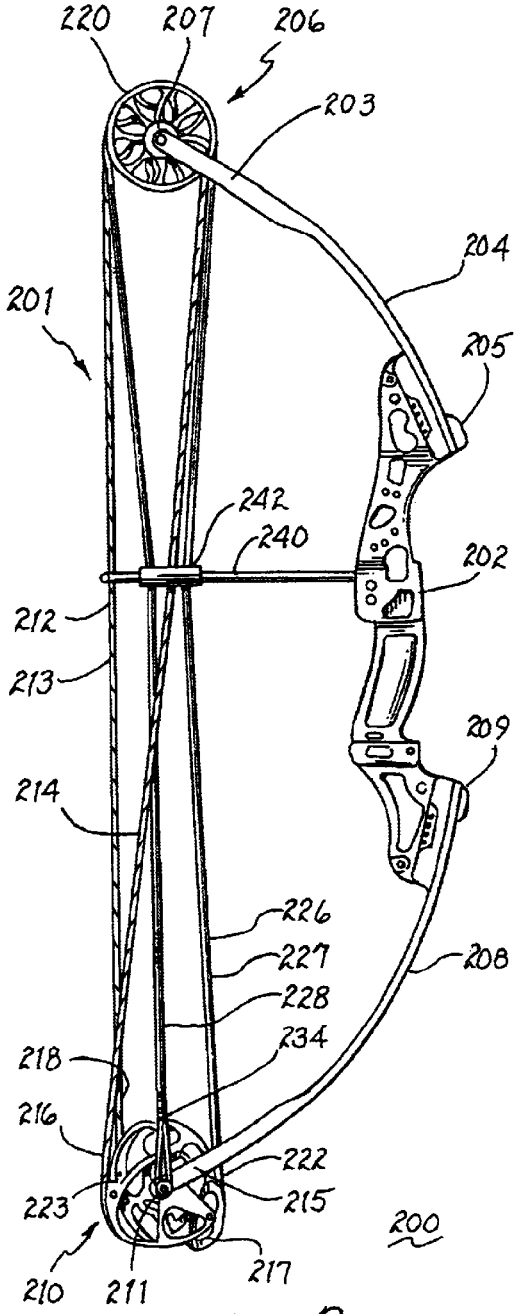
FIG. 2 is a side view of a single-cam compound bow in accordance with the invention.
Figure 3:
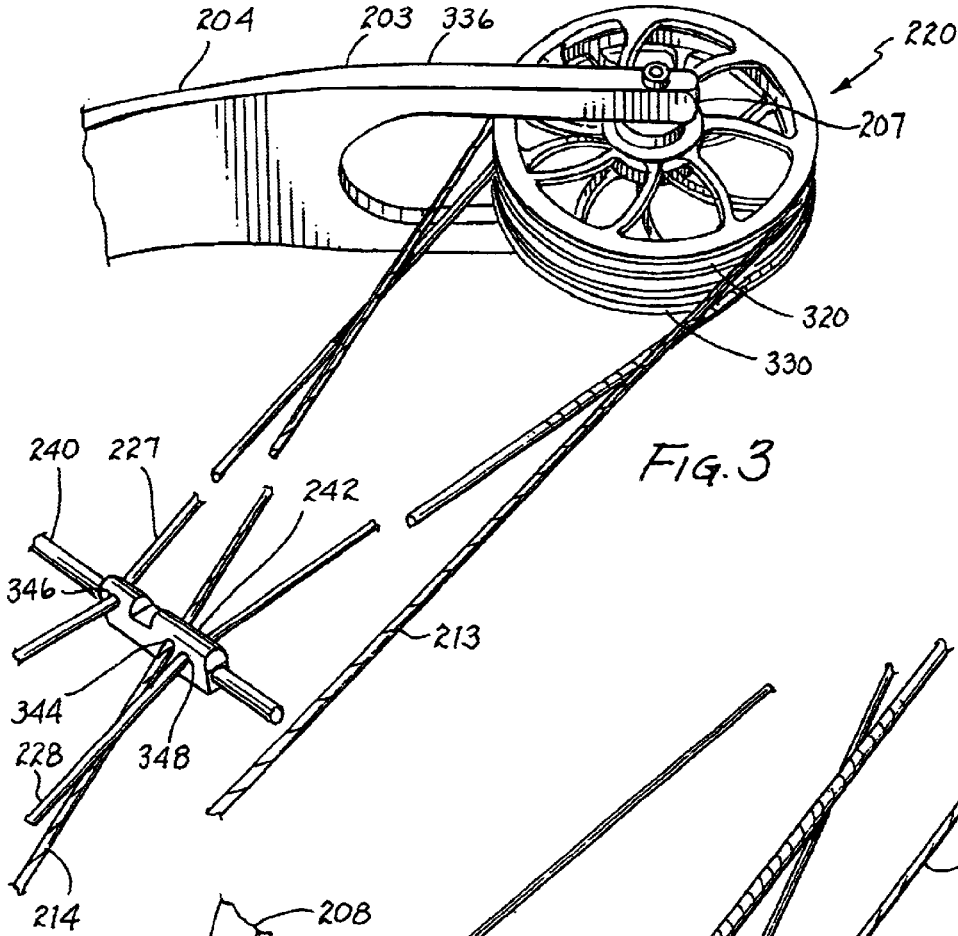
FIG. 3 is a perspective view showing a set of pulleys and a portion of rigging at a free end of a top limb of the single-cam compound bow of FIG. 2.

FIG. 2 is a side view of a single-cam compound bow 200 constructed in accordance with the invention. The single-cam compound bow 200 has a first end 206, shown as a top end, and a second end 210, shown as a bottom end. The single-cam compound bow 200 comprises a riser 202, a first limb 204 and a second limb 208. The first limb 204 has an inner end 205 connected to the riser 202 and a free outer end 207. The free outer end 207 terminates in a fork 203 (more clearly illustrated in FIG. 3). FIG. 3 is a perspective view showing a set 220 of idler pulleys, or pulleys, 320 and 330 mounted between sides 335 and 336 of the fork 203 at the free outer end 207 of the first limb 204.

Figure 4:
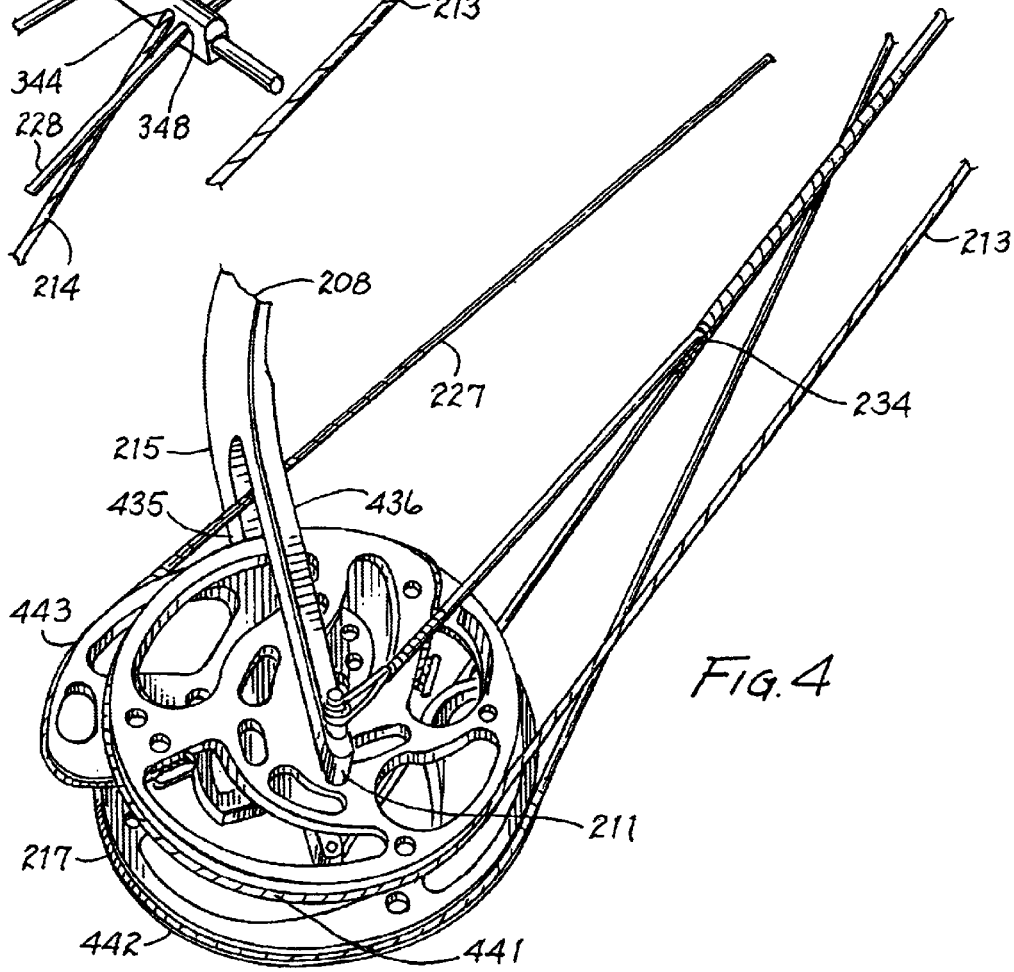
FIG. 4 is a perspective view showing a cam and a portion of rigging at a free end of a bottom limb of the single-cam compound bow of FIG. 2.

Referring again to FIG. 2, the second limb 208 has an inner end 209 connected to the riser 202 and a free outer end 211. The free outer end 211 terminates in a fork 215. A bowstring 212 extends between the free outer ends 207 and 211 of the first limb 204 and of the second limb 208, respectively. One end 216 of the bowstring 212 is at least partially wound around a cam 217 at the free outer end 211 of the second limb 208, respectively. FIG. 4 is a perspective view showing the cam 217 mounted between sides 435 and 436 of the fork 215 and a portion of rigging 201. The one end 216 of the bowstring 212 is at least partially wound around a first bowstring track 441 in the cam 217.

Referring now to FIGS. 2, 3 and 4, the bowstring 212 extends across the bow in a first stretch 213, and is wound around a bowstring pulley 320 mounted in the fork 203 at the free outer end 207 of the first limb 204. The bowstring 212 extends across the bow again in a second stretch 214, and the other end 218 of the bowstring is at least partially wound around a second bowstring track 442 in the cam 217 mounted in the fork 215 at the free outer end 211 of the second limb 208. One end 222 of a cable 226 is at least partially wound around a cable track 443 in the cam 217, and extends across the bow in a first stretch 227. The cable track 443 of the cam 217 has a minimum radius (not indicated). The cable 226 is wound around a cable pulley 330 mounted in the fork 203 at the free outer end 207 of the first limb 204, and the cable extends across the bow in a second stretch 228. The cable pulley 330 has a diameter 501 (see FIG. 5). Another end 223 of cable 226 is coupled to the free outer end 211 of the second limb 208 with a split harness 234. The split harness 234 advantageously evenly distributes forces to both sides 435 and 436 of the fork 215, thereby minimizing the twisting of the second limb 208. Preferably, the first stretch 227 of cable 226 and the second stretch 228 of cable 226 are one continuous cable 226.

Referring now to both FIG. 2 and FIG. 3, a cable guard rod 240 is attached to the riser 202. A cable guide 242 is slidably mounted on the cable guard rod 240. The cable guide 242 has a bowstring opening 344. The bowstring opening 344 is sized to allow the second stretch 214 of the bowstring 212 to move therethrough, thereby keeping the second stretch 214 of the bowstring 212 away from the plane of travel of the first stretch 213 of the bowstring. The cable guide 242 also has a first cable opening 346 sized to accept the first stretch of cable 226, and a second cable opening 348 sized to accept the second stretch 228 of cable. Advantageously, both the first stretch of cable 227 and the second stretch of cable 228 pass through the cable guide 242. The first cable opening 346 is separated from the second cable opening 348 by a distance (not indicated), which is less than the diameter of the cable pulley 330, and less than the radius of the cable track 443 of the cam 217. The first stretch 227 of cable 226 and the second stretch 228 of cable advantageously exert opposing forces on the cable guide 242 to reduce vibration of the cable guide when sliding on the cable guard rod 240 after release of the bowstring 212.

Figure 5:
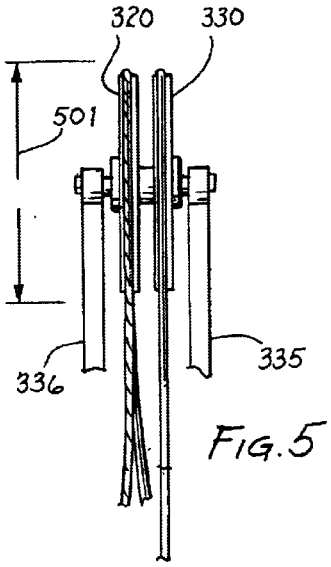
FIG. 5 is an end view of the set of pulleys and the portion of the rigging shown in FIG. 3.
Figure 6:
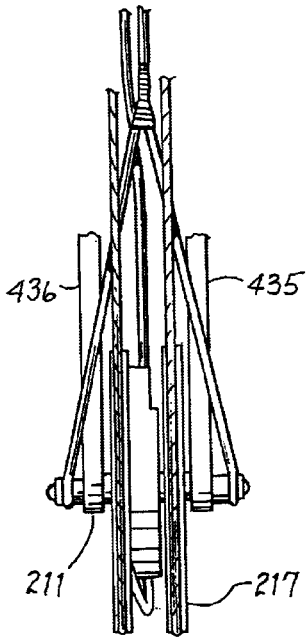
FIG. 6 is an end view of the cams and the portion of the rigging shown in FIG. 4.

FIG. 5 is an end view of the set 220 of pulleys shown in FIG. 3, and the corresponding portion of the rigging. With the rigging shown in FIG. 2, bowstring pulley 320 and cable pulley 330 rotate in a same direction. With an alternative rigging (not shown), bowstring pulley 320 and cable pulley 330 rotate in opposite directions. In the embodiment shown in FIG. 5, bowstring pulley 320 and cable pulley 330 have a same diameter 501; alternatively, they may have different diameters. FIG. 6 is an end view of the cam 217 shown in FIG. 3, and the corresponding portion of the rigging.

Figure 7:
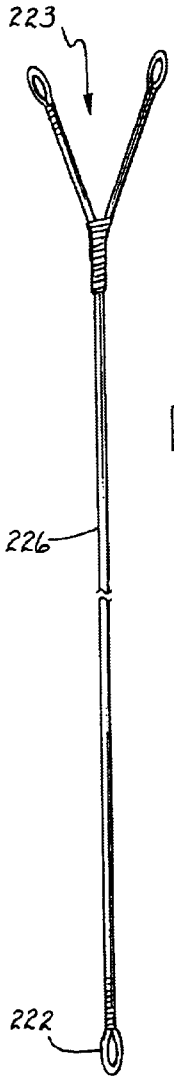
FIG. 7 shows the general shape of an unstrung cable for use with the set of pulleys shown in FIGS. 3 and 5.

FIG. 7 shows the general shape of an unstrung cable 226 for use with the set 220 of pulleys 320 and 330 shown in FIGS. 3 and 5. The cable 226 has one end 222 and another end 223.

Figure 8:
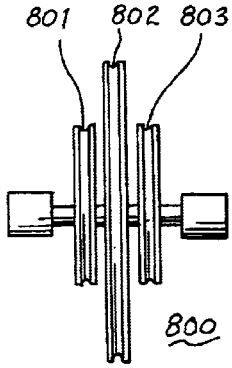
FIG. 8 is an end view of a first alternate set of pulleys.

FIG. 8 is an end view of a first alternate set 800 of pulleys 801–803 mounted between the sides 335 and 336 of the fork 203 at the free outer end 207 of the first limb 204 shown in FIG. 3. The first alternate set of pulleys comprises a bowstring pulley 802, and two cable pulleys.801 and 803, instead of the one cable pulley 330 of the embodiment shown in FIGS. 2, 3 and 5.

Figure 9:
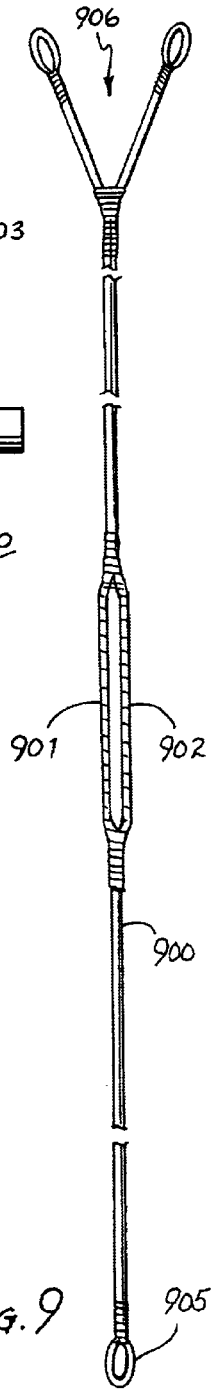
FIG. 9 shows the general shape of the unstrung cable for use with the first alternative set of pulleys shown in FIG. 8.

FIG. 9 shows the general shape of the unstrung cable 900 for use with the first alternative set 800 of pulleys 801–803 shown in FIG. 8. The cable 900 is split into two halves 901 and 902 for a short length. A midpoint of the short length is approximately intermediate the one end 905 and the other end 906 of the cable 900. One of the halves 901 is wound around one cable pulley 801 and the other of the halves 902 is wound around the other cable pulley 803. A length of the short length is only long enough to allow the two halves 901 and 902 of the cable 900 to remain in the grooves of cable pulleys 801 and 803 during draw and release of the single-cam compound bow 200.

Figure 10:
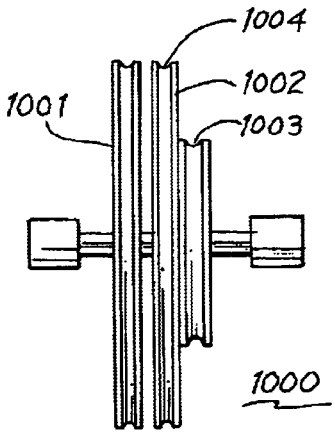
FIG. 10 is an end view of a second alternate set of pulleys.

FIG. 10 is an end view of a second alternate set 1000 of pulleys 1001–1002 mounted between the sides 335 and 336 of the fork 203 at the free outer end 207 of the first limb 204 shown in FIG. 3 The second alternate set 1000 of pulleys 1001–1002 comprises a bowstring pulley 1001, and a mechanical pulley 1002. The mechanical pulley 1002 has one portion 1003 and another portion 1004. In the embodiment shown in FIG. 10, one portion 1003 has a smaller diameter than the other portion 1004; alternatively, other portion 1004 has a smaller diameter than the one portion 1003. As a further alternate, the portions 1003 and 1004 of the mechanical pulley 1002 have a same diameter.

Figure 11:
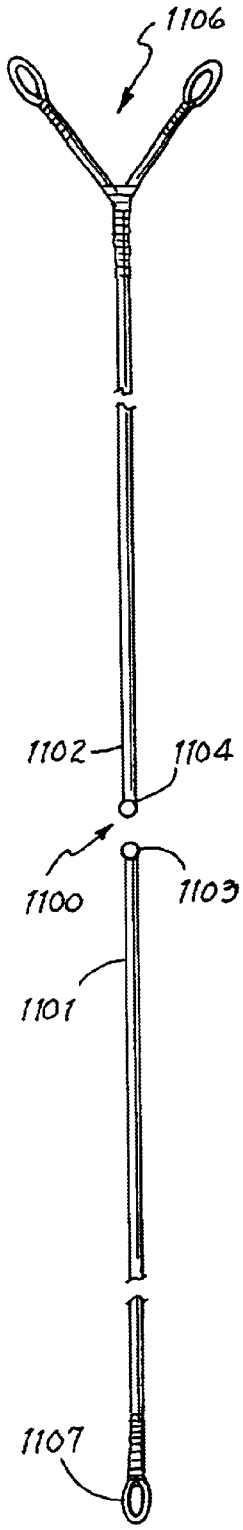
FIG. 11 shows the general shape of the unstrung cable for use with the second alternative set of pulleys shown in FIG. 10.

FIG. 11 shows the general shape of the unstrung cable 1100 for use with the second alternative set 1000 of pulleys 1001–1002 shown in FIG. 10. The cable for use with the second alternate set 1000 of pulleys 1001–1002 comprises two separate cable portions 1101 and 1102. Cable portion 1101 is for use in the first stretch of cable 227, and cable portion 1102 is for use in the second stretch of cable 228.

Referring now to both FIG. 10 and FIG. 11, a first end 1103 of the first cable portion 1101 is at least partially wound around the one portion 1003 of the mechanical pulley 1002, and a first end 1104 of the second cable portion 1102 is at least partially wound around the other portion 1004 of the mechanical pulley. A second end 1107 of the first cable portion 1101 is at least partially wound around the cam 217, and a second end 1106 of the second cable portion 1102 is connected to the free outer end 211 of the second limb 208.

Figure 12:
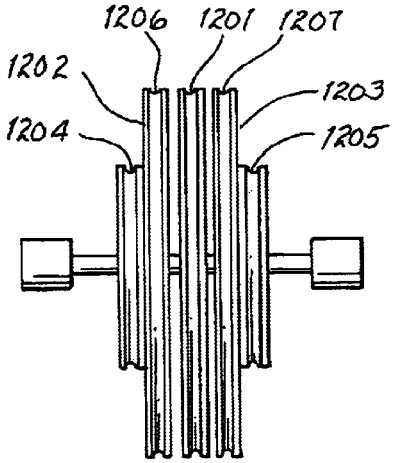
FIG. 12 is an end view of a third alternate set of pulleys.

FIG. 12 is an end view of a third alternate set 1200 of pulleys 1201–1203. The third alternate set 1200 of pulleys 1201–1203 comprises a bowstring pulley 1201, and two mechanical pulleys 1202 and 1203. Mechanical pulley 1202 has one portion 1204 and another portion 1206. Mechanical pulley 1203 has one portion 1205 and another portion 1207. In the embodiment shown in FIG. 12, one portion 1204 has a smaller diameter than the other portion 1206; alternatively, other portion 1206 has a smaller diameter than the one portion 1204. As a further alternate, the portions 1204 and 1206 of the mechanical pulley 1202 have a same diameter. Mechanical pulley 1203, and its portions 1205 and 1207 are similar to mechanical pulley 1202, and have similar alternate embodiments. The bowstring pulley 1201 is not limited to the size show in FIG. 12, and can be larger or smaller than the mechanical pulleys 1202 and 1203.

Figure 13:
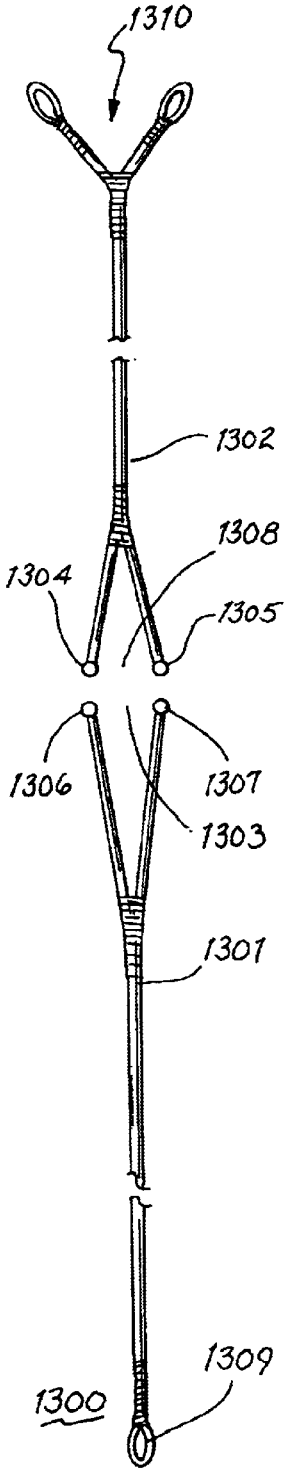
FIG. 13 shows the general shape of the unstrung cable for use with the third alternative set of pulleys shown in FIG. 12.

FIG. 13 shows the general shape of the unstrung cable 1300 for use with the third alternative set 1200 of pulleys 1201–1203 shown in FIG. 12. The cable for use with the third alternate set 1200 of pulleys 1201–1203 comprises two separate cable portions 1301 and 1302. First cable portion

1301 is for use in the first stretch of cable 227, and cable portion 1302 is for use in the second stretch of cable 228. The first cable portion 1301 has a first end 1303 that terminates in a split harness that has two halves 1306 and 1307. The second cable portion 1302 has a first end 1308 that terminates in a split harness that has two halves 1304 and 1305.

Referring now to both FIG. 12 and FIG. 13, the halves 1306 and 1307 at the first end 1303 of the first cable portion 1301 are at least partially wound around the portion 1206 of mechanical pulley 1202 and at least partially around portion 1207 of mechanical pulley 1203, respectively. The halves 1304 and 1305 at the first end 1308 of the second cable portion 1302 is at least partially wound around the portion 1204 of mechanical pulley 1202 and at least partially around portion 1205 of mechanical pulley 1203, respectively. A second end 1309 of the first cable portion 1301 is at least partially wound around the cam 217, and a second end 1310 of the second cable portion 1302 is connected to the free outer end 211 of the second limb 208.

Use of one or more mechanical pulleys at the first end 206 of the single-cam compound bow 200 allows use of two shorter cable portions, such as first cable portion 1101 and second cable portion 1102, rather than one longer portion, as the cable 226, which may be advantageous under certain circumstances. When the tracks of the mechanical pulleys have different diameters, a mechanical advantage is gained, which allows the rigging to bend the limbs 204 and 208, more or less (depending upon which portion of the mechanical pulley has a larger diameter track) than when the tracks have a same diameter. Advantageously, use of mechanical pulleys having tracks of different diameters gives a designer control over the amount of limb bend.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

List of Reference Numerals

100 Prior Art Single-cam Compound Bow
102 Rigging of Prior Art Single-cam Compound Bow
104 Bowstring of Prior Art Single-cam Compound Bow
105 First Stretch of Bowstring of Prior Art Single-cam Compound Bow
106 Cam of Prior Art Single-cam Compound Bow
108 Bottom Limb Tip of Prior Art Single-cam Compound Bow
110 Bowstring Pulley of Prior Art Single-cam Compound Bow
112 Top Limb Tip of Prior Art Single-cam Compound Bow
113 Second Stretch of Bowstring of Prior Art Single-cam Compound Bow
116 Cable of Prior Art Single-cam Compound Bow
117 Single Stretch of Cable of Prior Art Single-cam Compound Bow
118 Split Harness of Prior Art Single-cam Compound Bow
200 Single-cam Compound Bow, in accordance with the invention
201 Rigging
202 Riser
203 Fork at Free End of First Limb,
204 First Limb
205 Inner End of First Limb
206 First End of Single-cam Compound Bow
207 Free Outer End of First Limb
208 Second Limb
209 Inner End of Second Limb
210 Second End of Single-Cam Compound Bow
211 Free Outer End of Second Limb
212 Bowstring
213 First Stretch of Bowstring
214 Second Stretch of Bowstring
215 Fork at Free Outer End of Second Limb
216 One End of Bowstring
217 Cam
218 Other End of Bowstring
220 Set of Pulleys
222 One End of Cable
223 Another End of Cable
226 Cable
227 First Stretch of Cable
228 Second Stretch of Cable
234 Split Harness
240 Cable Guard
242 Cable guide
320 Bowstring Pulley of Set of Pulleys
330 Cable Pulley of Set of Pulleys
335,336 Sides of Fork at Free Outer End of First Limb
344 Bowstring Opening in Cable guide
346 First Cable Opening in Cable Guard
348 Second Cable Opening in Cable Guard
435,436 Sides of Fork at Free Outer End of Second Limb
441 First Bowstring Track in Cam
442 Second Bowstring Track in Cam
443 Cable Track in Cam
501 Diameter of Pulleys in the Set of Pulleys
800 First Alternate Set of Pulleys
801 One Cable Pulley of First Alternate Set of Pulleys
802 Bowstring Pulley of First Alternate Set of Pulleys
803 Other Cable Pulley of First Alternate Set of Pulleys
900 Unstrung Cable for Use with First Alternate Set of Pulleys
901 One of the Halves of the Unstrung Cable
902 Other of the Halves of the Unstrung Cable
905 One End of the Unstrung Cable for Use with First Alternate Set of Pulleys
906 Other End of the Unstrung Cable for Use with First Alternate Set of Pulleys
1000 Second Alternate Set of Pulleys
1001 Bowstring Pulley
1002 Mechanical Pulley
1003 One Portion of the Mechanical Pulley
1004 Another Portion of the Mechanical Pulley
1100 Unstrung Cable for use with Second Alternate Set of Pulleys
1101 First Cable Portion
1102 Second Cable Portion
1103 First End of First Cable Portion
1104 First End of Second Cable Portion
1106 Second End of Second Cable Portion
1107 Second End of First Cable Portion
1200 Third Alternate Set of Pulleys
1201 Bowstring Pulley
1202 Mechanical Pulley
1203 Mechanical Pulley
1204 One Portion of other Mechanical Pulley
1205 One Portion of one Mechanical Pulley
1206 Another Portion of other Technical Pulley
1207 Another Portion of one Mechanical Pulley

1300 Unstrung Cable for Use with Third Alternate Set of Pulleys
1301 First Cable Portion
1302 Second Cable Portion
1303 First End of First Cable Portion
1304,1305 Halves at First End of Second Cable Portion
1306,1307 Halves at First End of First Cable Portion
1308 First End of Second Cable Portion
1309 Second End of First Cable Portion
1310 Second End of Second Cable Portion

We claim:

1. In a single-cam compound bow having a handle riser, a first limb and a second limb, each limb having an inner end connected to said handle riser and a free outer end, and two stretches of a bowstring extending between the free outer ends of the limbs, the improvement comprising: a first and a second stretch of cable extending between the free outer ends of said limbs.

2. The single-cam compound bow of claim 1, including at least one cable pulley mounted at the free end of the first limb, and in which said first stretch of cable and said second stretch of cable are one continuous cable having a first end and a second end, and in which said one continuous cable is wound around said cable pulley and extends between said first and second limbs to form said first and second stretches of cable.

3. The single-cam compound bow of claim 2, including at least one cam mounted at the free end of the second limb, and in which said one end of said one continuous cable is at least partially wound around said cam, and in which the other end of said one continuous cable is secured to the free end of the second limb.

4. The single-cam compound bow of claim 3, including a fork at the free end of the second limb, said fork having a left side and a right side, and in which said second end of the continuous cable is secured to both the left side of the fork and to the right side of the fork to thereby split cable forces equally between the right side of the fork and the left side of the fork.

5. The single-cam compound bow of claim 4, in which said one continuous cable is split into two cable halves near the second end of said continuous cable, one of said cable halves being connected to the left side of the fork, and the other of the cable halves being connected to the right side of the fork.

6. The single-cam compound bow of claim 2, including two cable pulleys mounted at the free end of the first limb, and in which said one continuous cable is split into two halves for a short length, each of the halves being wound around a different one of said cable pulleys respectively.

7. The single-cam compound bow of claim 6, including a left cable pulley, a center bowstring pulley, and a right cable pulley mounted at the free end of the first limb, one of said cable halves being wound around the left cable pulley and the other of said cable halves being wound around the right cable pulley.

8. The single-cam compound bow of claim 7, in which the center pulley has a diameter and the left and right cable pulleys have a smaller diameter.

9. The single-cam compound bow of claim 1, including a cable guard rod fixed to the handle and a cable slide slidably mounted on said rod, said cable slide having a first cable opening, a second cable opening and a length, in which the first stretch of cable passes through the first cable opening and the second stretch of cable passes through the second cable opening, the first cable opening and second cable opening being spaced apart along said length by a predetermined distance.

10. The single-cam compound bow of claim 9, including at least one cable pulley mounted at the free end of the first limb, the at least one cable pulley having a diameter, and in which said predetermined distance between the first cable opening and the second cable opening in the cable slide is less than the diameter of the at least one cable pulley, such that the first stretch of cable and the second stretch of cable exert opposing forces on the cable slide to reduce vibration of the cable slide when sliding on the rod after release of the bowstring.

11. The single-cam compound bow of claim 10, including a cam mounted at the free end of the second limb, the cam having a cable track for the first stretch of cable, the cable track having a minimum radius, and in which the distance between the first cable opening in said cable guide and the second cable opening in the cable guide is less than the minimum radius of the cable track.

12. The single-cam compound bow of claim 10, in which the first cable opening is near a first end of the cable guide and the second cable opening is near a second end of the cable slide, said first and second cable guide ends being at opposite sides of the length of the cable slide, and including a bowstring opening in the cable slide intermediate the other first cable opening and the second cable opening.

13. The single-cam compound bow of claim 1 including at least one mechanical pulley, having two portions, mounted at the free end of the first limb, and in which a first end of said first stretch of cable is at least partially wound around one portion of said mechanical pulley, and a first end of the second stretch of cable is at least partially wound around the other portion of said mechanical pulley.

14. The single-cam compound bow of claim 13, including a cam mounted at the free end of the second limb, and in which a second end of the first stretch of cable is at least partially wound around the cam, and a second end of the second stretch of cable is secured to the free end of the second limb.

15. The single-cam compound bow of claim 14, including a fork at the free end of the second limb, the fork having a left side and a right side, and in which the second end of the second stretch of cable is secured to both the left side of the fork and the right side of the fork to thereby split cable forces equally between the right side of the fork and the left side of the fork.

16. The single-cam compound bow of claim 15, in which the second stretch of cable is split into two cable halves, one of the cable halves being connected to the left side of the fork and the other of the cable halves being connected to the right side of the fork.

17. The single-cam compound bow of claim 13, in which the two portions of the mechanical pulley have unequal diameters.

18. A single-cam compound bow, comprising:

a riser;

a first limb having an inner end connected to the riser and a free outer end;

a second limb having an inner end connected to the riser and a free outer end;

two stretches of a bowstring extending between the free outer ends of the limbs;

a first stretch of cable extending between the free outer ends of the limbs; and a second stretch of cable extending between the free outer ends of the limbs.

19. The single-cam compound bow of claim 18, including a pulley mounted at the free outer end of the first limb and a cam mounted at the free outer end of the second limb, and in which one end of the first stretch of cable is at least partially wound around the cam and another end of the first stretch of cable is at least partially wound around the pulley.

20. The single-cam compound bow of claim 19, including a fork at the free end of the second limb, the fork having a left side and a right side, and in which one end of the second stretch of cable is at least partially wound around the pulley, and another end of the second stretch of cable is connected to both the left side of the fork and the right side of the fork through means for dividing cable forces equally between the right side of the fork and the left side of the fork.

* * * * *